US007019203B2

(12) United States Patent
Wolberg et al.

(10) Patent No.: US 7,019,203 B2
(45) Date of Patent: Mar. 28, 2006

(54) AUTOMATIC PAGE TURNER WITH TURNSTILE ELEMENT

(75) Inventors: George Wolberg, Woodmere, NY (US); Ali Sadegh, Franklin Lakes, NJ (US)

(73) Assignee: Pageflip, Inc., Woodmere, NY (US)

( * ) Notice: Subject to any disclaimer, the term of this patent is extended or adjusted under 35 U.S.C. 154(b) by 64 days.

(21) Appl. No.: 10/747,989

(22) Filed: Dec. 29, 2003

(65) Prior Publication Data

US 2005/0145097 A1 Jul. 7, 2005

(51) Int. Cl.
*G10G 7/00* (2006.01)

(52) U.S. Cl. ..... 84/486

(58) Field of Classification Search ..... 84/486–489, 84/491–516

See application file for complete search history.

(56) References Cited

U.S. PATENT DOCUMENTS

| | | | | |
|---|---|---|---|---|
| 4,040,195 A | | 8/1977 | Claypool et al. | 40/341 |
| 4,160,334 A | | 7/1979 | Willis | 40/531 |
| 4,463,651 A | * | 8/1984 | Hammer | 84/504 |
| 4,644,675 A | | 2/1987 | Berger et al. | 40/531 |
| 4,685,374 A | * | 8/1987 | Goldner | 84/487 |
| 4,719,712 A | | 1/1988 | Moreau et al. | 40/475 |
| 5,203,248 A | | 4/1993 | Carr et al. | 84/487 |
| 5,233,900 A | | 8/1993 | Fitzgerald | 84/497 |
| 5,373,772 A | | 12/1994 | Shemoul | 84/486 |
| 5,493,943 A | | 2/1996 | Horikawa | 84/519 |
| 5,575,097 A | | 11/1996 | Chou et al. | 40/531 |
| 5,962,801 A | | 10/1999 | Bowman et al. | 84/486 |
| 6,049,033 A | * | 4/2000 | Dallas | 84/486 |
| 6,107,558 A | | 8/2000 | Cowan | 84/488 |
| 6,215,058 B1 | | 4/2001 | Molchak et al. | 84/486 |

* cited by examiner

*Primary Examiner*—Kimberly Lockett
(74) *Attorney, Agent, or Firm*—Marc Karish; Sheldon & Mak

(57) ABSTRACT

An apparatus for turning bound pages, the apparatus having a support assembly for holding the bound pages; a lifting assembly coupled to the support assembly and capable of lifting at least a portion of a page; a turnstile assembly, the turnstile assembly comprising a plurality of flippers; and a motor assembly secured to the support assembly and coupled to the turnstile assembly; wherein the turnstile assembly has a rest position in which one of the plurality of flippers is positioned across two opposed bound pages to hold the bound pages in an open condition; wherein the turnstile assembly is rotated by the motor assembly causing the lifting assembly to lift one of the pages and one of the plurality of flippers to rotate underneath the lifted page; and wherein the finger underneath the lifted page is rotated to turn the page and to place the turnstile in the rest position.

26 Claims, 13 Drawing Sheets

AUTOMATIC PAGE TURNER WITH TURNSTILE ELEMENT

BACKGROUND

The present invention relates to a system and method for automatically turning the pages of a book, magazine, or any bound printed matter in the forward or reverse directions.

Page turning is an important ancillary process of reading. It is a pervasive task that many people take for granted. An automatic page turner can assist people with disabilities and the elderly, who may have limited upper extremity function. A page turner can also furnish hands-free operation to musicians, and provide avid readers with convenient book support and page turning features.

While there are many patents on the subject of automatic page turners, virtually none of them have led to successful working products. This is due to the fact that all of the patents lack one or two of the three major functions of a successful page turner: engagement with the page, transport of the page, and restraining the book pages to lie flat. The prior art is replete with designs that are too bulky, noisy, unreliable, or burden the user with the requirement to attach clips or tabs to each page.

Some relevant patents in this area include: U.S. Pat. No. 4,040,195 to Claypool et al., U.S. Pat. No. 4,160,334 to Willis, U.S. Pat. No. 4,644,675 to Berger et al., U.S. Pat. No. 4,719,712 to Moreau et al., U.S. Pat. No. 5,203,248 to Carr et al., U.S. Pat. No. 5,233,900 to Fitzgerald, U.S. Pat. No. 5,373,772 to Shemoul, U.S. Pat. No. 5,493,943 to Horikawa, U.S. Pat. No. 5,575,097 to Chou et al., U.S. Pat. No. 5,962,801 to Bowman et al., and U.S. Pat. No. 6,049,033 to Dallas.

The present invention seeks to remedy the defects of the prior art.

SUMMARY

Accordingly, the present invention, is directed to an apparatus for turning bound pages that remedies the defects of the prior art. According to a first embodiment of the present invention, the apparatus has a support assembly for holding the bound pages. A lifting assembly is coupled to the support assembly and is capable of lifting a portion of a page. The apparatus also has a turnstile assembly, the turnstile assembly having multiple flippers. A motor assembly is coupled to the support assembly and coupled to the turnstile assembly.

The turnstile assembly has a rest position in which one of the flippers is positioned across two opposed bound pages to hold the bound pages in an open condition. The turnstile assembly is rotated by the motor assembly causing the lifting assembly to lift one of the pages and one of the plurality of flippers to rotate underneath the lifted page. The finger underneath the lifted page is rotated to turn the page and to place the turnstile in the rest position.

Optionally, the support assembly has an expandable bracket for supporting a spine of the bound pages. A horizontal crossbar can be mounted on the expandable bracket. A pair of expandable folding arms can be coupled to the horizontal crossbar.

The motor assembly can have a reversible electric motor and a gear reducer coupled to the electric motor. An output shaft is coupled to the gear reducer and to the turnstile assembly. Left and right limiting switches are coupled to the electric motor.

The turnstile assembly can have a disk coupled to the output shaft of the reducing gear, the disk having a top surface and a side surface. A plurality of pins are coupled to the top surface of the disk and a plurality of limiting pins are coupled to the side surface of the disk. Each of the limiting pins is engageable with the left limiting switch and the right limiting switch.

The lifting assembly can include a right lifting assembly and a left lifting assembly. Each lifting assembly can have a base assembly having a track, a board slideably coupled to the track, an L-shaped bracket coupled to the board, and a linkage rotatably coupled to the board. The L-shaped bracket can have a rotatable bias pin, the bias pin being engageable with at least one of the plurality of pins coupled to the top surface of the disk.

Each lifting assembly can also have a finger assembly comprising a bar, a yoke rotatably coupled to the board and rotatably coupled to the bar. A cam is coupled to the bar, the cam being engageable with the roller coupled to the support assembly. Upon rotation of the turnstile assembly, at least one of the pins on the disc engages the pin on the L-shaped bracket causing the board to slide along the track and the cam to engage with the roller coupled to the support assembly, thereby causing the bar to rotate relative to the yoke, thereby bringing an end of the bar into contact with a page. Continued rotation of the turnstile assembly causes the linkage to engage another of the plurality of pins on the disc, thereby causing the linkage to rotate the bar and the yoke relative to the board, thereby lifting a page. Optionally, a flexible bellow is attached to the distal end of the bar.

According to a second embodiment of the present invention, the apparatus has a rotatable turnstile assembly, the turnstile assembly comprising at least one lifting finger. A transportation assembly is coupled to the turnstile assembly. The transportation assembly has a plurality of finger assemblies. The transportation assembly has a rest position in which the finger assemblies hold the bound pages in an open condition. Rotation of the turnstile assembly moves the transportation assembly in a lateral direction to lift one of the pages and moves the lifting finger underneath the lifted page. The lifting finger underneath the lifted page is then rotated to turn the page.

BRIEF DESCRIPTION OF THE DRAWINGS

A better understanding of the present invention will be had with reference to the accompanying drawings in which.

DETAILED DESCRIPTION

Figure 1:
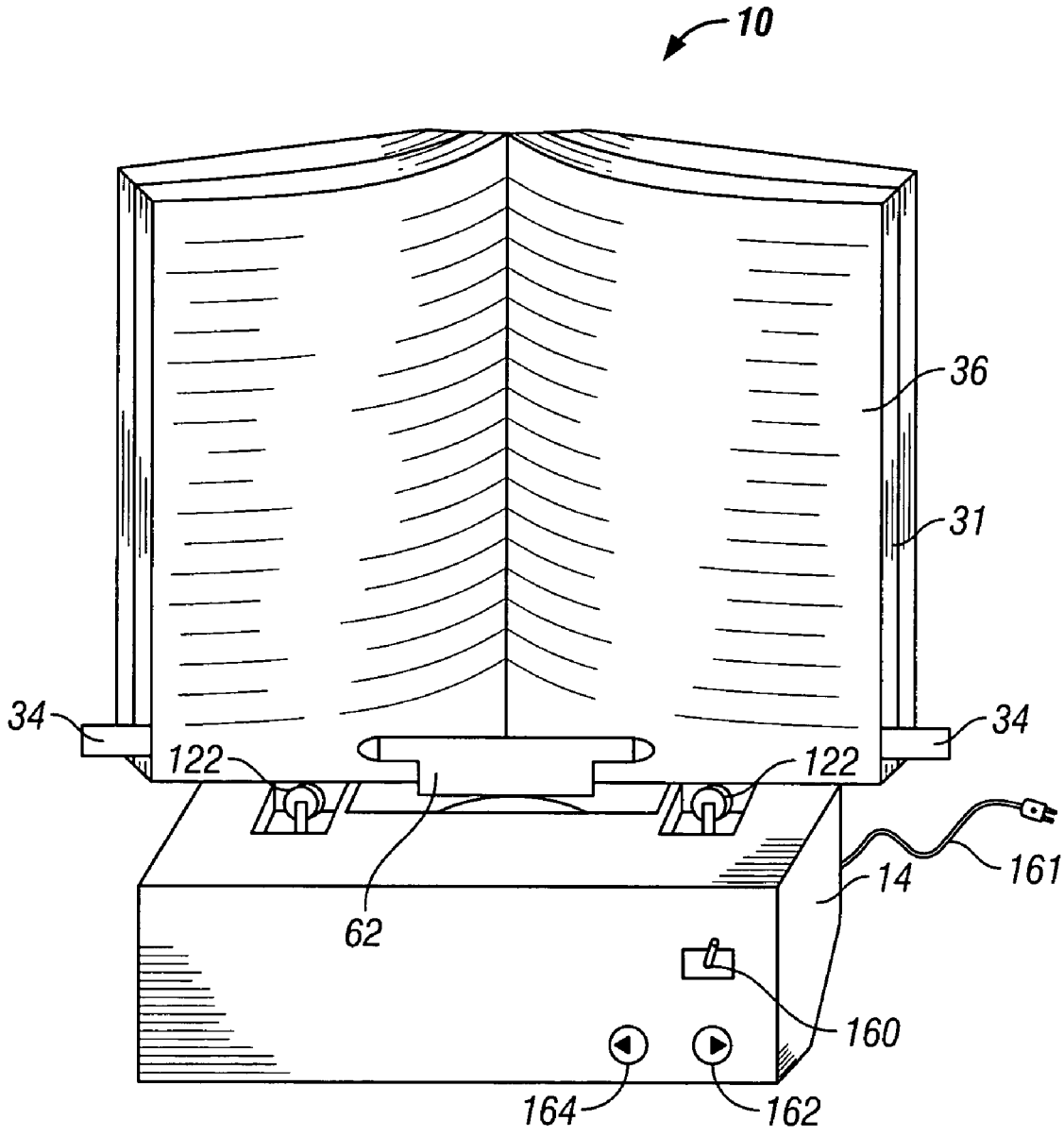
FIG. 1 is a front perspective view of a page turner according to a first embodiment of the present invention shown with a casing and a book.
Figure 2:
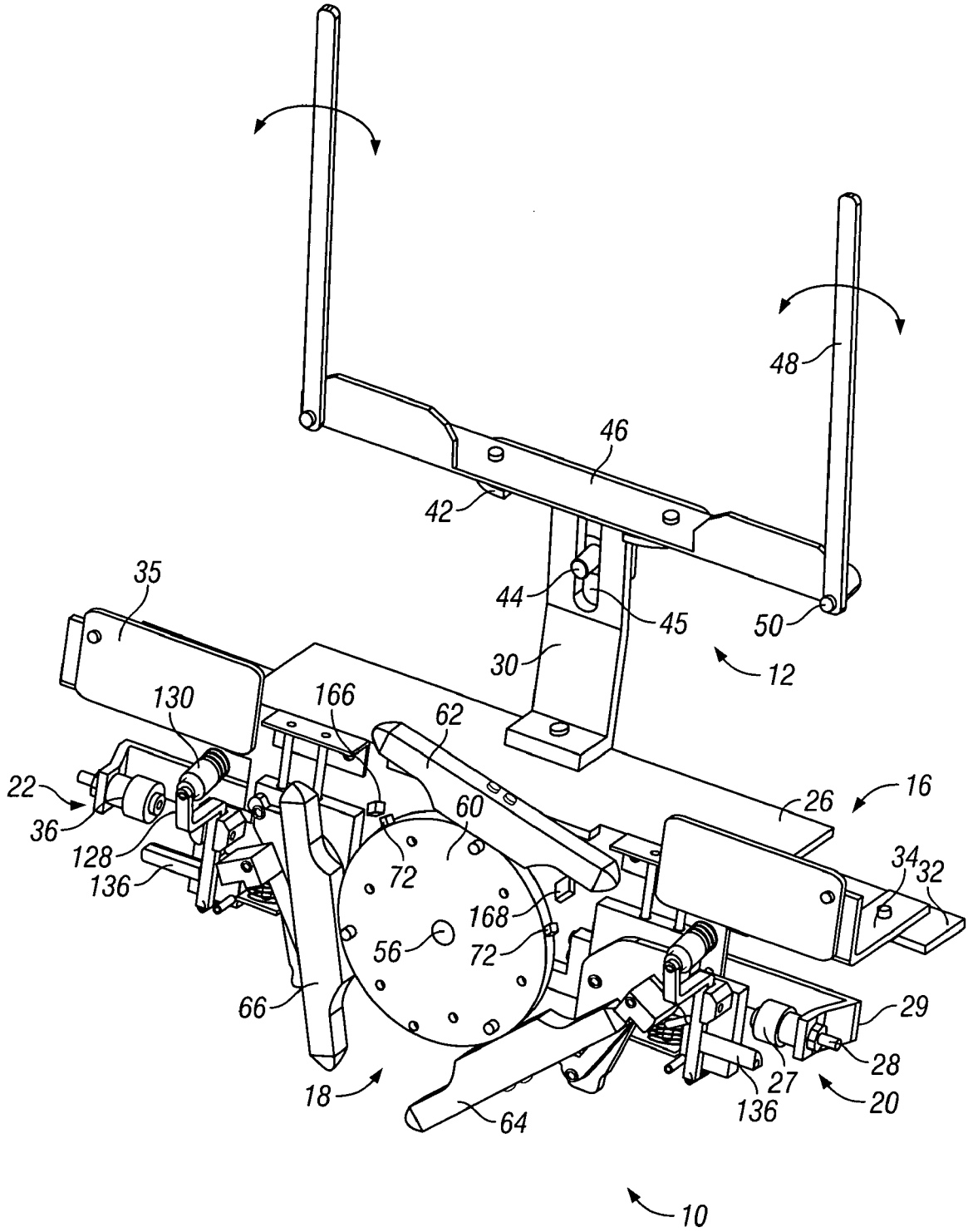
FIG. 2 is a front perspective view of the page turner of FIG. 1 without the casing.
Figure 3:
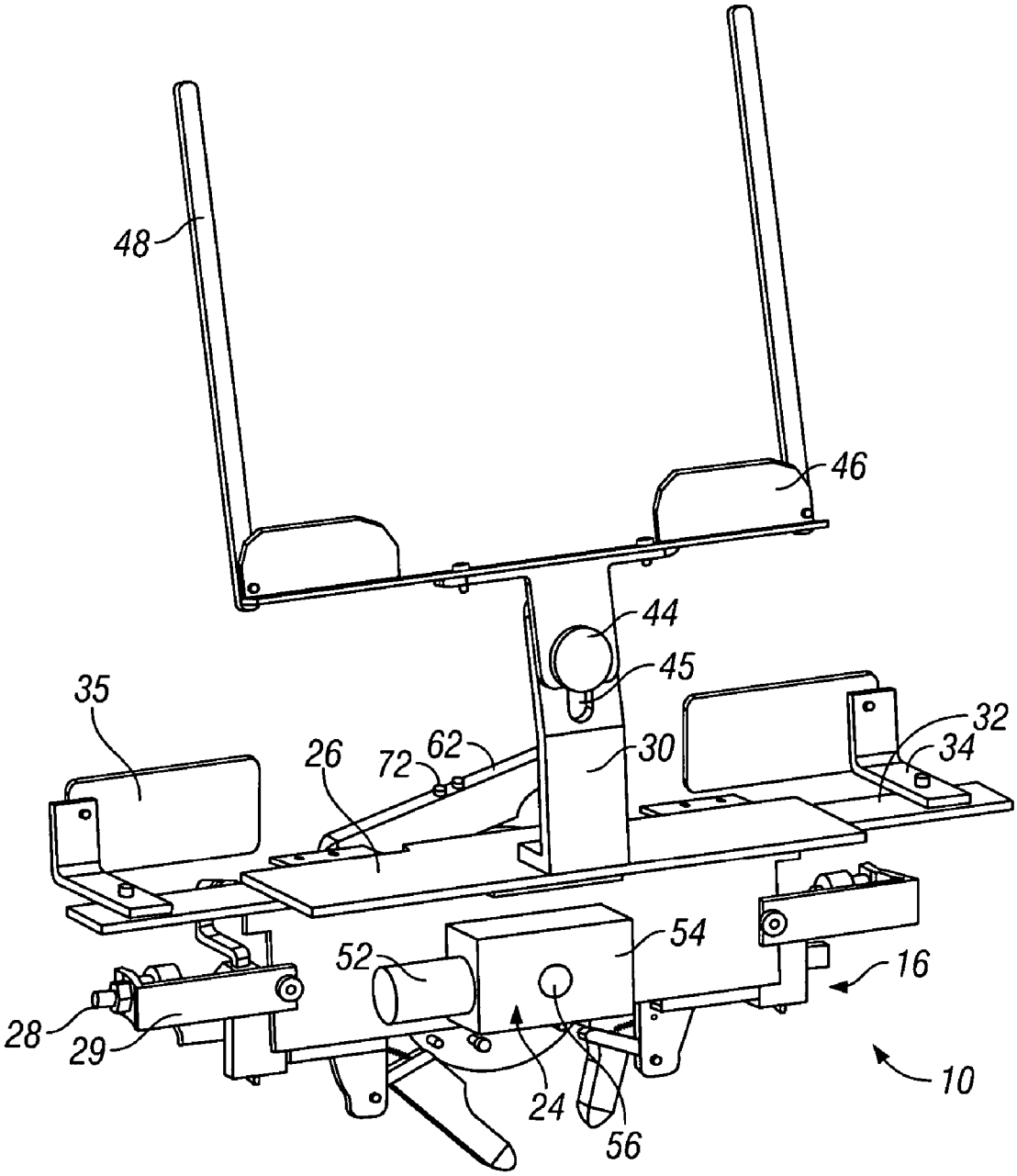
FIG. 3 is a rear perspective view of the page turner of FIG. 1.

Referring to FIGS. 1 to 3, an automatic page turner 10 according to a first embodiment of the present invention generally has a book support assembly 12, a casing 14, a main frame 16, a turnstile assembly 18, a right-side page curling assembly 20, a left-side page curling assembly 22 and a motor assembly 24. The main frame 16 has an as L-shaped frame 26 on which the motor assembly 24, the book support assembly 12, the turnstile assembly 18 and the page curling assemblies 20, 22 are rigidly attached. The casing 14 is rigidly attached to the L-shaped frame 26, and covers the attachments to the L-shaped frame 26.

Two rollers 27 are located on the sides of the main frame 16. The rollers 27 are rigidly connected to the main frame 16 through axles 28 and brackets 29. The rollers 27 can freely rotate on the axles 28. As explained below, the rollers 27 are utilized by the page curling assemblies 20, 22.

Considering the book support assembly in more detail, as shown in FIGS. 1 and 2, a support bracket 30 is attached to an upper section of the L-shaped frame 26 to restrain a book 31. Two extension bars 32 are attached to the L-shaped frame 26. A bracket 34 is attached to each extension bar 32. A leaf spring 35 is attached to bracket 34. The leaf springs 35 support the top 50 to 100 pages 36 of the book 31 that are to be turned.

Referring to FIG. 2, a T-bracket 42 is moveably connected to the support bracket 30 through a screw 44 and a slot 45. The height of the T-bracket 42 can be increased or decreased by sliding the T-bracket 42 over the support bracket 30 and then tightening the screw 44. A horizontal section of the T-bracket 42 has a wide surface where the spine of the book 31 is placed. The wide surface prevents the book 31 from sliding off the T-bracket 42.

To support larger soft cover books, a horizontal extending bar 46 is attached to the T-bracket 42 using a fastener, such as screws or clamps. Folding arms 48 are rotatably attached to the ends of the extending bar 46 by hinges 50. The folding arms 48 can rotate from 0 to 180 degrees as needed to provide support for large books.

Considering the motor assembly 24 in more detail, as shown in FIG. 3, the motor assembly 24 is rigidly connected to the frame 26 and comprises a reversible electric motor 52, a gear reduction box 54 and an output shaft 56. The electric motor 52 can rotate in the clockwise and counterclockwise directions. The gear box 54 reduces and adjusts the output speed of the motor to a desired speed for turning a book page. The output shaft 56 of the motor 52 transmits the rotation of the motor 52 to the turnstile assembly 18.

Figure 4:
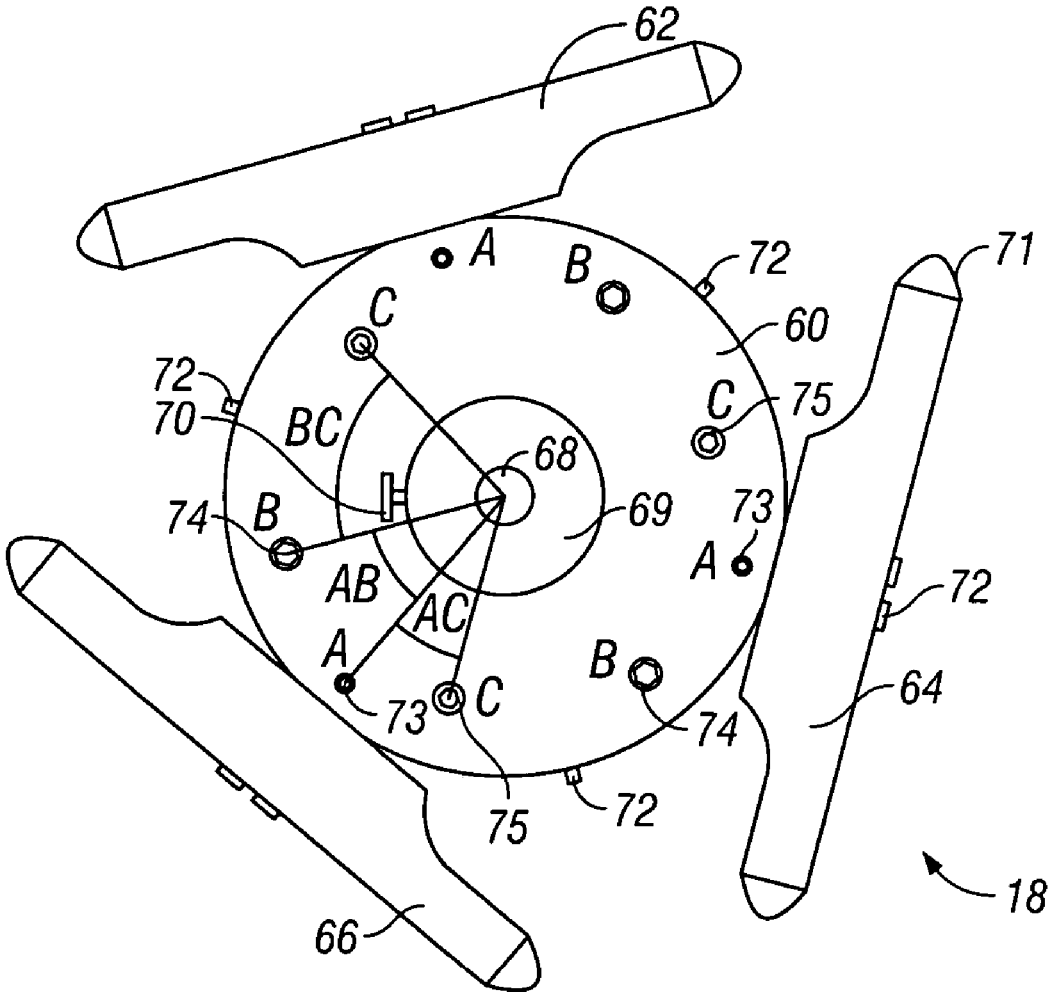
FIG. 4 is a front view of a turnstile assembly of the page turner of FIG. 1.

Referring to FIG. 4, the turnstile assembly 18 comprises a disc 60. Three page flippers 62, 64 and 66 are coupled to the disc 60. The disc has a center hole 68 surrounded by a sleeve 69. The output shaft 56 of the motor assembly is inserted into the center hole 68 and is rigidly connected to the disc 60 through a fastener, such as a set screw 70 coupled to the sleeve 69.

Considering the three page flippers 62, 64, and 66 in more detail, both ends of each page flipper have a smooth conical tip 71. Each page flipper is tangentially and rigidly connected to the side of the disc 60 through two fasteners 72, such as screws. The orientation of the page flippers 62, 64 and 66 is such that the points of contact with the disc 60 are the three vertices of an equilateral triangle. Therefore, the page flippers are 120 degrees apart and are symmetric with respect to the center hole 68.

Three sets of pins, set A 73, set B 74 and set C 75, are perpendicularly mounted to a surface of the disc 60. Each set has three pins, with one of the three pins being associated with each of the page flippers. The pins of a set are oriented with a 120 degree angular distance between them, as shown in FIG. 4.

The relative orientation of the sets to each other will now be described. One pin of set A 73 is located between one pin of set B 74 and one pin of set C 75. One pin from each of set A 73, set B 74, and set C 75 form a group of pins associated with one of the page flippers 62, 64 and 66.

Additionally, three limiting pins 72 are placed at equal intervals on a side of the disc 60. The limiting pins 72 contact switches coupled to the motor once the disc 60 has rotated sufficiently to turn a page as explained in more detail below.

The relative positions of pins within a group will now be described. The radial distance of the pins of set A from the center hole is the largest. The radial distance of the pins of set C from the center hole is the shortest. Within each group, the angular distance AC between the pin of set A 73 and the pin of set C 75 is smaller than the angular distance AB between the pin of set A and the pin of set B.

Figure 5:
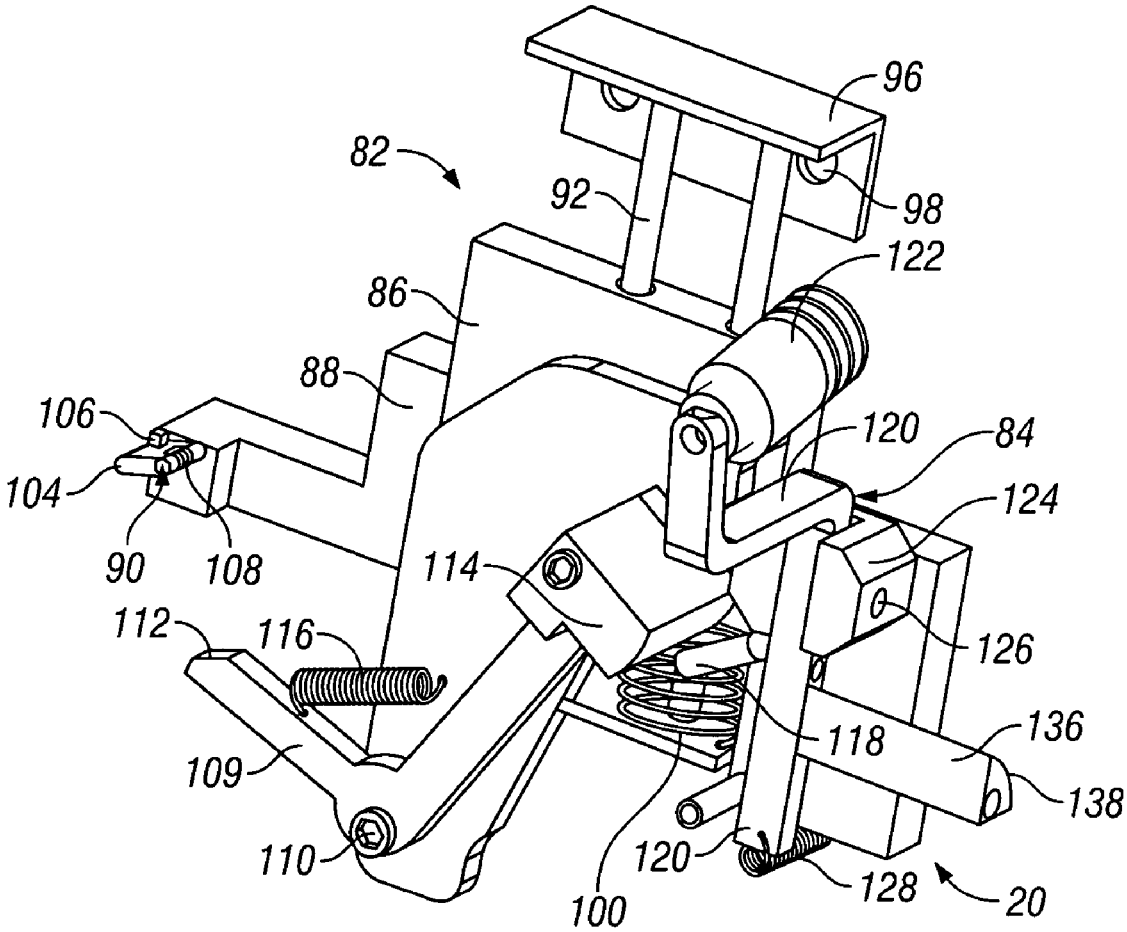
FIG. 5 is a front perspective view of a right side page curling assembly of the page turner of FIG. 1.

Referring to FIG. 5, the right-side page curling assembly 20 comprises a base assembly 82 and a finger assembly 84. The base assembly 82 comprises a board 86 and an L-shaped bracket 88 connected to the board. A pin assembly 90 is connected to the L-shaped bracket. A pair of parallel tracks 92, that can be rod shaped, travel through holes in the board 86. The tracks 92 are attached to an anchor bracket 96. The anchor bracket 96 is attached to the L-shaped frame 26 using fasteners, such as screws, placed through holes 98 in the anchor bracket. The board 86 slides over the tracks 92 with minimal friction and a spring 100 applies a downward bias force to the board 86 to hold the board at a bottom end of the tracks 92, away from the book 31.

The pin assembly 90 is connected to the distal end of the L-shaped bracket 88 and comprises an arm 104, a stopper 106 and a torsional spring 108. The torsional spring 108 applies a clockwise bias torque to the pin assembly 90 and the stopper 106 prevents the complete rotation of the arm 104. Thus, the pin assembly 90 rotates about 270 degrees in a counterclockwise direction. The pin assembly 90 engages with the pins of pin set A 73 on the disc 60.

As shown in FIG. 5, an L-shaped linkage 109 is rotatably connected to the board 86 through a hinge 110. The L-shaped linkage 109 has a tip 112 on a first end. The tip 112 engages with the pins of pin set B 74 on the disc 60 as will be described below. A cam 114 is connected to a second end of the L-shaped linkage 109 for contacting and rotating the finger assembly 84. A spring 116 connects the L-shaped linkage 109 to the board 86 and applies a tensional bias force to the L-shaped linkage 109 causing the L-shaped linkage 109 to rotate clockwise, which keeps the cam 114 in contact with a follower 118 on the finger assembly 84.

Figure 6:
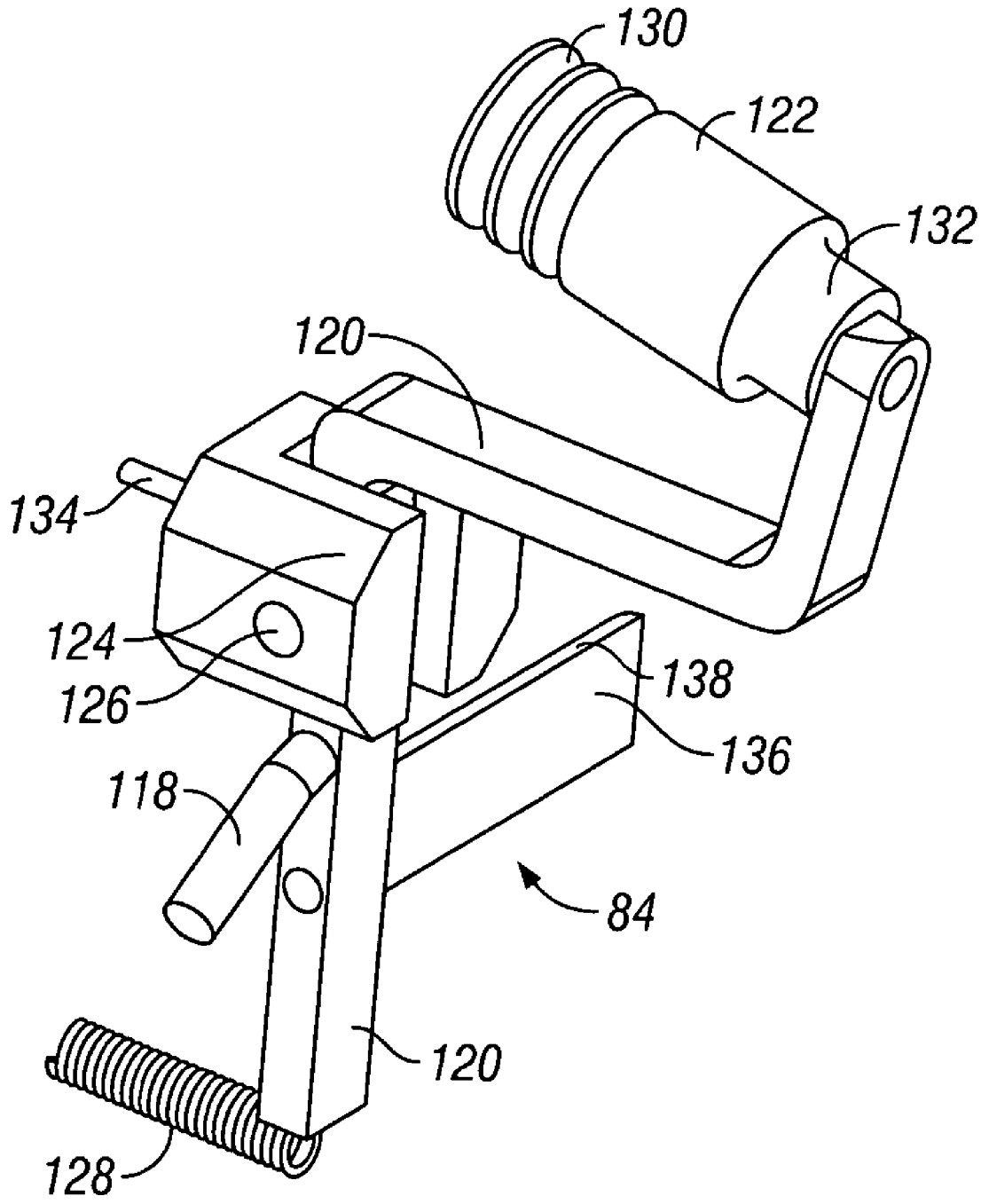
FIG. 6 is a front perspective view of a finger assembly of the page turner of FIG. 1.

Referring to FIGS. 5 and 6, the right side finger assembly 84 has an S-shaped bar 120, a flexible bellow 122 and a yoke 124. The S-shaped bar 120 is rotatably connected to the yoke 124 through a pin 126 allowing the S-shaped bar 120 to rotate in a vertical plane. A spring 128 connects a distal end of the S-shaped bar 120 to the board 86 and applies a downward bias force to the distal end of the S-shaped bar 120. The bias force keeps the proximal tip of the S-shaped bar 120 upward and away from the book. A distal end 130 of the bellow 122 is circumferentially corrugated (accordion shaped) to allow a large deflection. A proximal end 132 of the bellow 122 is connected to a proximal end of the bar 120 using a pin.

The yoke 124 has a support 134, which is inserted into a hole in the board 86 allowing the finger assembly 84 to rotate in a horizontal plane in both clockwise and counterclockwise directions. A longitudinal cam 136 is rigidly attached to a side of the S-shaped bar 120, near the distal end. The longitudinal cam 136 has a smooth curve 138, as shown in FIG. 5.

As seen in FIGS. 2 and 5, upon forward motion of the finger assembly 84, the curve 138 moves over the roller 27 causing the S-shaped bar 120 to rotate about the yoke pin 126 toward a book page. Upon rearward motion of the finger assembly 84, the spring 128 brings the S-shaped bar 120 to an upward rest position.

The follower 118 is rigidly attached to the S-shaped bar 120 on a side opposite to the cam 136. Upon clockwise rotation of the L-shaped linkage 109, the base assembly cam 114 contacts the follower 118, causing the finger assembly 84 to rotate about the support 134 in a counterclockwise direction.

Figure 7:
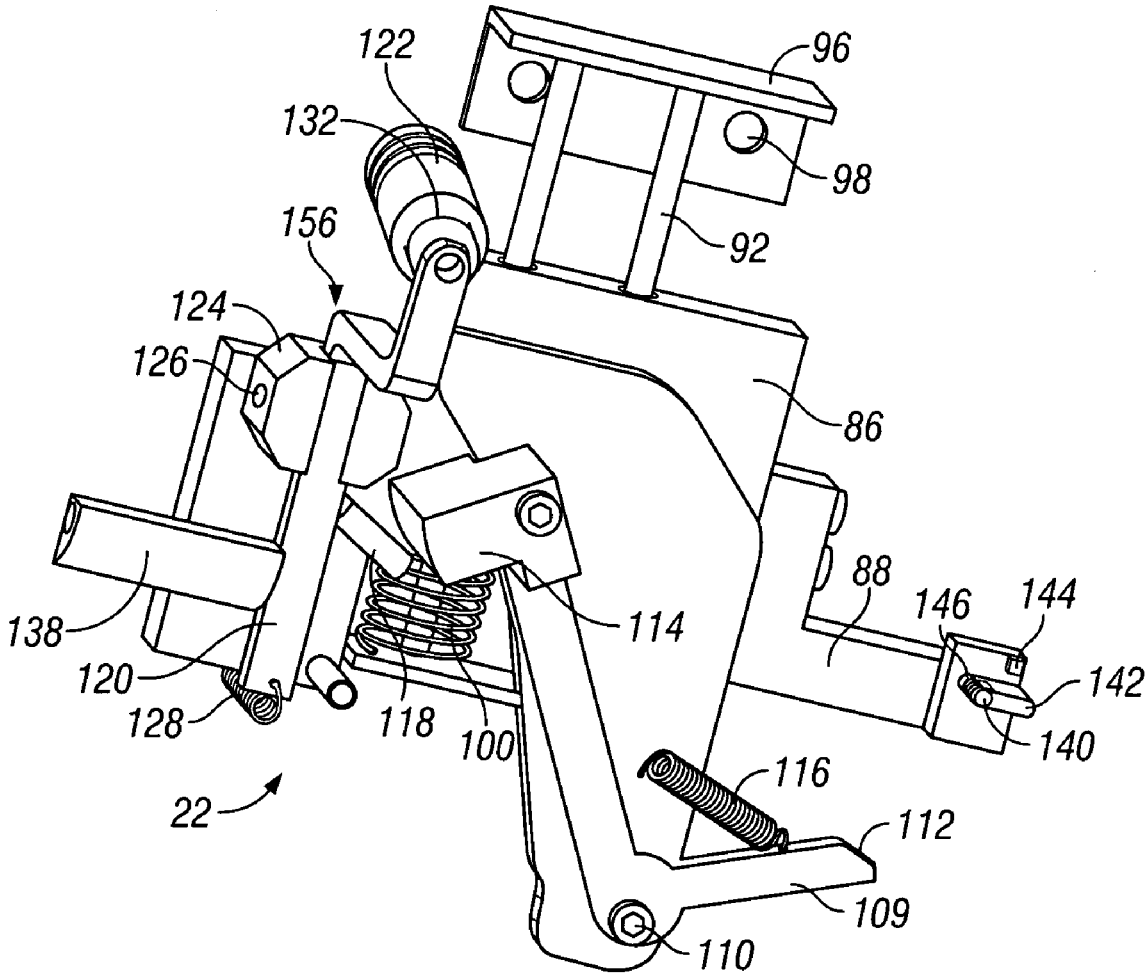
FIG. 7 is a front perspective view of a left side page curling assembly of the page turner of FIG. 1.
Figure 8:
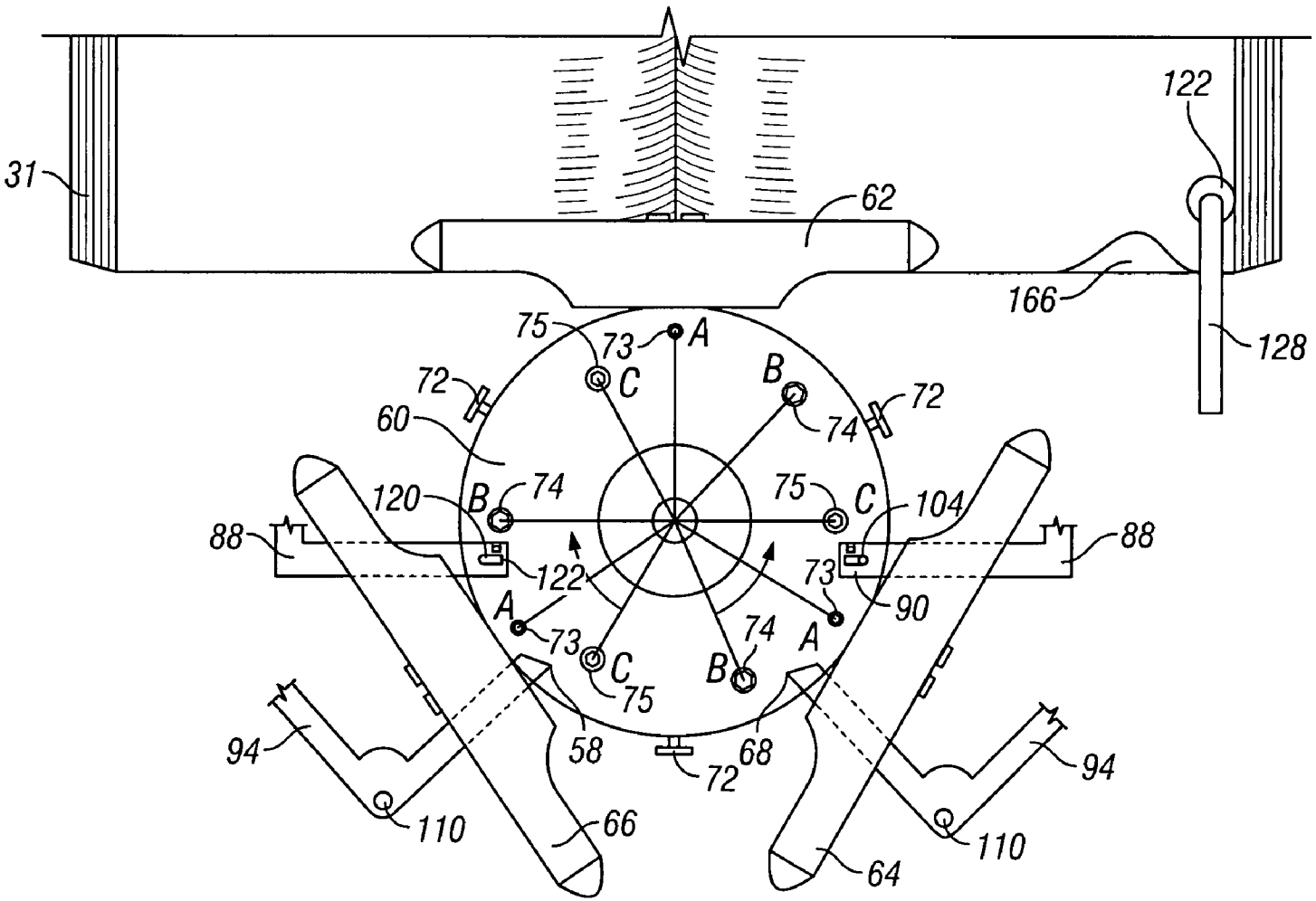
FIG. 8 is a front view of a turnstile assembly showing the orientations of the pins with respect to the left and the right side curling assemblies.

Referring to FIG. 7, the left-side page curling assembly 22 is the mirror image of the right-side page curling assembly 20 with some exceptions. First, the tip end 112 of the L-shaped linkage 109 is slightly longer to engage pin set C 75. Second, a pin assembly 140 is rigidly attached to a distal end of the L-shaped bracket 88 and comprises an arm 142, a stopper 144 and a torsional spring 146. The torsional spring 146 applies a counterclockwise bias torque to the pin assembly 140 and the stopper 144 prevents the complete rotation of the arm 142. Thus, the pin assembly 140 rotates about 270 degrees in a clockwise direction. The pin assembly 140 is engageable with pin set A 73 on the disc 60.

The left side finger assembly 156 is the same as the right side finger assembly 84 except that the cam 114 is on the left side of the L-shaped linkage 109 and the follower 118 is located on the right side of the bar 120.

Referring again to FIG. 2, the right side page curling assembly 20 and the left side page curling assembly 22 are positioned on opposite ends of the device and disposed symmetrically with respect to the center of the disc 60. The right side page curling assembly 20 turns a page forward, curling the right side page and transporting the page from right to left. The left side page curling assembly 22 turns a page backward, curling the left side page and transporting the page to the right side.

As shown in FIG. 1, an on/off switch 160 located on the casing 14 energizes the page turner 10 through an electric cord 161 to a conventional electric outlet (not shown). In a portable cordless version of the apparatus, a set of small batteries are used to energize the page turner 10. Upon manually pressing a forward switch 162, the motor 52 is energized and the gear reducer 54 rotates the output shaft 56 and the disc 60 in a counterclockwise direction and turns a page from right to left.

Similarly, pressing a reverse button 164, the motor 52 is energized and the gear reducer 54 rotates the output shaft 56 and the disc 60 in a clockwise direction and turns a page from left to right. Other activation means, such as foot pedals, breath-controlled switches, chin switches, or voice activation devices can be used to energize the motor 52 in either forward or reverse directions.

Operation of the page turner 10 first involves restraining the book 31 in the book support assembly 12. The height of the T-bracket 42 may be adjusted by the screw 44. Depending on the size of the book, a user may open the folding arms 48 and extend the supports for each side of the book as necessary. While resting the spine of the book on the support bracket 30, a user places a desired number of pages, for example approximately 50 to 100 pages for one hour reading, above the leaf springs 35, on either side of and under the page flipper 62, as shown in FIG. 2.

A rest position of the turnstile assembly 18 is such that the page flipper 62 is parallel to the lower edge of the book and is restraining the bottom of the book. The 50 to 100 pages of reading are restrained between the leaf spring 35 and the page flipper 62. Additionally, the orientation of pin set A 73 is slightly below the pin assemblies 90 and 140 on the right and the left sides, respectively.

Referring to FIGS. 2, 5, 8, 9 and 10, an exemplary sequence of operation will now be described. When the forward switch 162 is activated, the motor 52 is energized and the output shaft 56 rotates the disc 60 counterclockwise. As the disc 60 rotates, a pin of pin set A 73 contacts the pin assembly 90 of the right side page curling assembly 20. Because of the stopper 106, the pin of pin set A moves the right side base assembly 82 and the right side finger assembly 84 along the tracks 92 and closer to the book.

Forward movement of the base assembly 82 brings the finger tip bellow 122 over the lower margin area of the book. At the same time, the cam 136 of the finger assembly 84 goes over the roller 27 which pushes the rear section of the finger assembly 84 upward, bringing the tip 130 of the finger assembly 84 downward. The bellow 122 of the finger assembly 84 is moved over the book and brought downwardly onto a page 36. The lips of the bellow 122 contact the book page 36 on its lower margin area.

As the base assembly is moved forward, the L-shaped linkage 109, which is coupled to the base assembly, is also moved forward in a linear direction, parallel to the tracks 92. This linear movement brings the tip 112 of the L-shaped linkage onto the disc 60 and closer to the center hole 68. Therefore, as the pin of pin set A 73 moves the pin assembly 90 forward, a pin of pin set B 74 contacts the tip 112 of the L-shaped linkage 109. The pin of pin set B moves the tip 112 forward causing the L-shaped linkage 109 to rotate clockwise about the hinge 110. Clockwise rotation of the L-shaped linkage brings the cam 114 in contact with the follower 118 causing the finger assembly 127 to rotate counterclockwise around the support 134 of the yoke 124.

Figure 9:
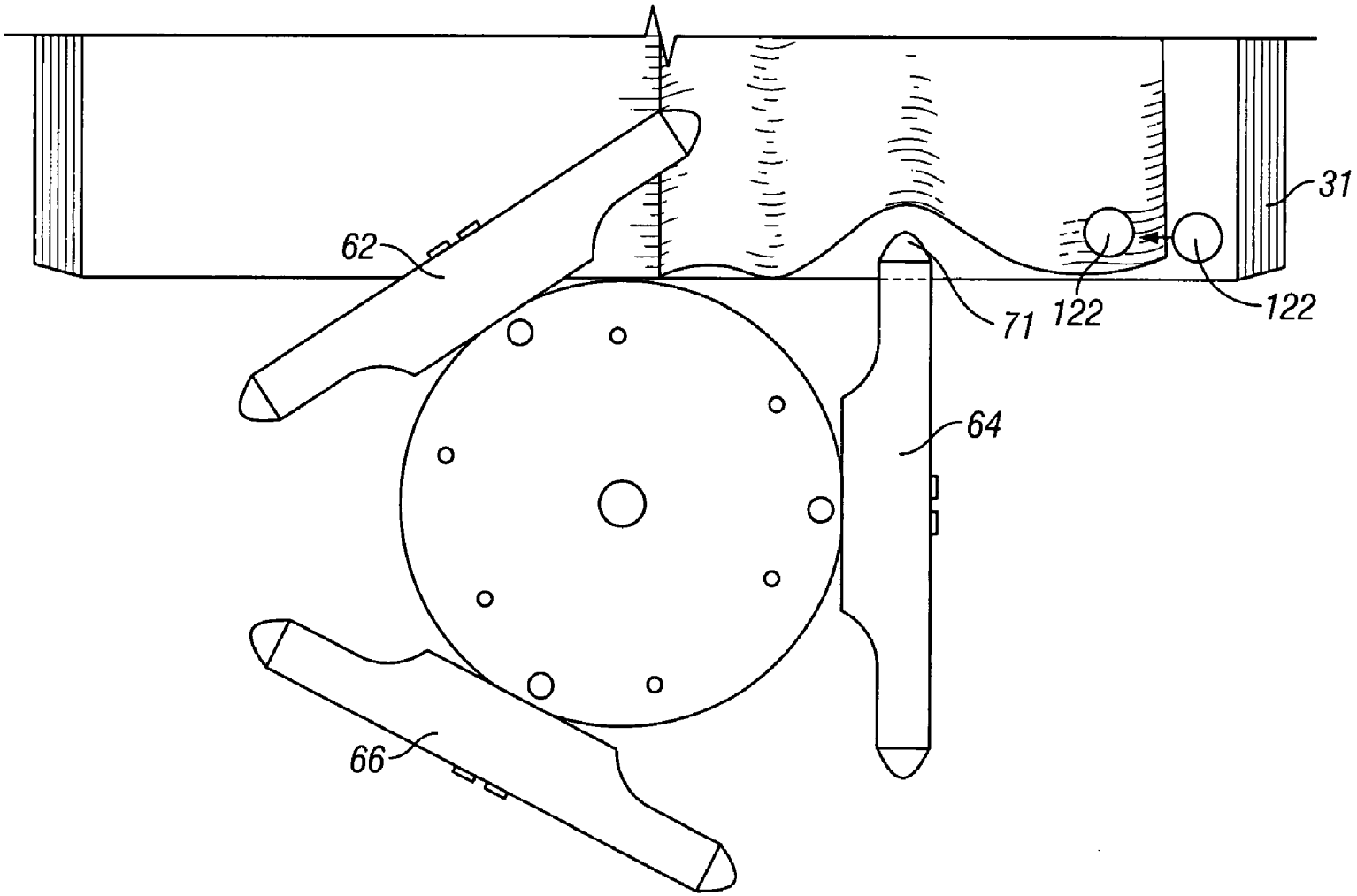
FIG. 9 is an illustration of a first portion of the page turning process according to the first embodiment of the present invention.
Figure 10:
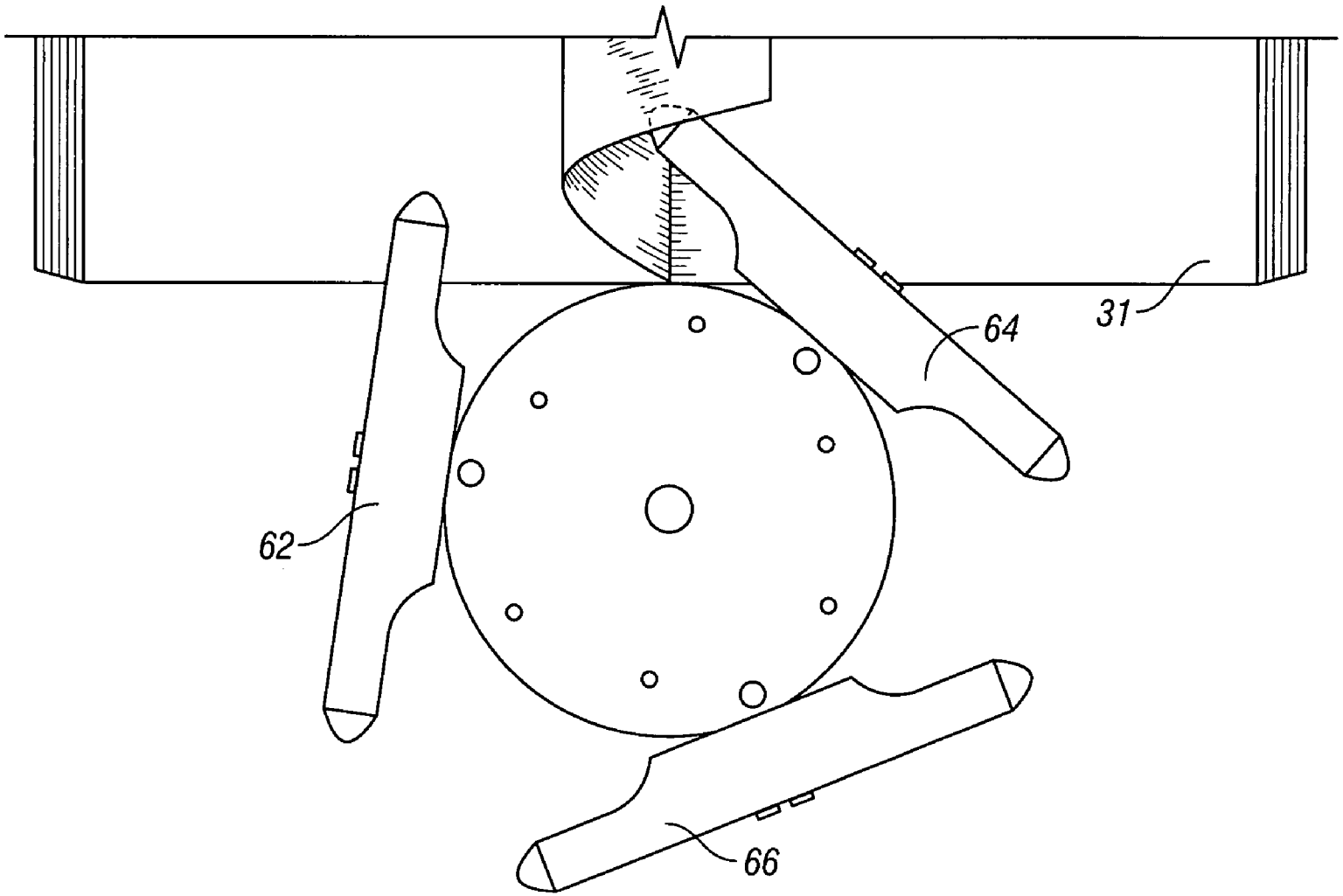
FIG. 10 is a schematic view depicting a second portion of the page turning process according to the first embodiment of the present invention.

Consequently, while the bellow 122 is in contact with the page 36, the finger assembly 84 is rotated to the left causing the top page of the book to form a curl 166. At the time the curl 166 is formed, the disc 60 has turned about 60 degrees and the tip 71 of the page flipper 64 is moved under the curled page 166 as shown in FIG. 9. Further rotation of the disc 60 moves the page flipper 64 over the lower margin of the book while transporting the page 36 to the other side to complete the cycle. Once the page flipper 64 is in the horizontal position, or the disc has rotated 120 degrees, a limiting switch 166 (shown in FIG. 2) is activated by a limiting pin 72 and the motor 52 is turned off. The page forwarding action can be repeated by pressing the forward switch 162.

No pins of pin set B 74 or pin set C 75 come in contact with the pin assembly 140 of the left side page curling assembly 22. A pin of pin set A 73 does contact the arm 142 of the left pin assembly 140. However, the arm 142 rotates on its own axis and does not move the left side page curling assembly 22. The torsional spring 146 brings back the arm 142 to the stopper 144 position.

The pages are turned backward when a reverse button 164 is activated. The motor 52 is then energized and the shaft 56 rotates the disc 60 clockwise. As the disc 60 rotates, a pin of pin set A 73 contacts the pin assembly 140 of the left side page curling assembly 22. Because of the stopper 144, the pin of pin set A 73 moves the left side base assembly 82 and the left side finger assembly 156 forward along the tracks 92 toward the book 31.

As with the right side page curling assembly, forward movement of the base assembly 82 and the finger assembly 84 brings the finger tip bellow 122 over the lower margin area of the book and at the same time brings the tip of the bellow 122 downward. Thus, the lips of the bellow 122 come in contact with the book page in the lower margin area, on the left side. At the same time, the base assembly 82 is moved forward along with the L-shaped linkage 109 in a linear direction parallel to the tracks. This linear movement brings the tip 112 of the L-shaped linkage 109 onto the disc 60 region and closer to the center hole 68. As the pin set A 73 moves the pin forward, a pin of pin set C 75 comes in contact with the tip 112 of the L-shaped linkage 109 and moves the tip forward causing the L-shaped linkage 109 to rotate counterclockwise about the pivot point.

Counterclockwise rotation of the L-shaped linkage 109 on the left side, moves the bellow 122 of the finger assembly 84 toward the right side of the book, thereby causing the top page of the book on the left side, to create a curl. At the time the curl is made, the disc 60 has turned about 60 degrees and the tip 71 of the page flipper 66 is moved under the curled page. Further rotation of the disc 60 moves the page flipper 66 over the lower margin of the book while transporting the page to the other side to complete the cycle.

Once the page flipper 66 is in the horizontal position, or the disc has rotated 120 degrees, a limiting switch 168 on the right side (shown in FIG. 2) is activated by a limiting pin 72 and the motor 52 is turned off. No pins of the pin set C 75 or the pin set B 74 come in contact with the pin assembly 90 of the right side page curling assembly 20. A pin of pin set A 73 does contact the arm 104 of the right pin assembly 90. However, the arm 104 rotates on its own axis and does not move the right side page curling assembly 20. The torsional spring 108 brings back the arm 104 to the stopper 106 position. The page reversing action may be repeated by pressing the reverse button 164.

It will be understood by those skilled in the art that other means for curling a book page may be employed in place of the bellow 122. For example, a suction means may be employed to lift a portion of the page to allow a page flipper to get under the lifted portion.

Figure 11:
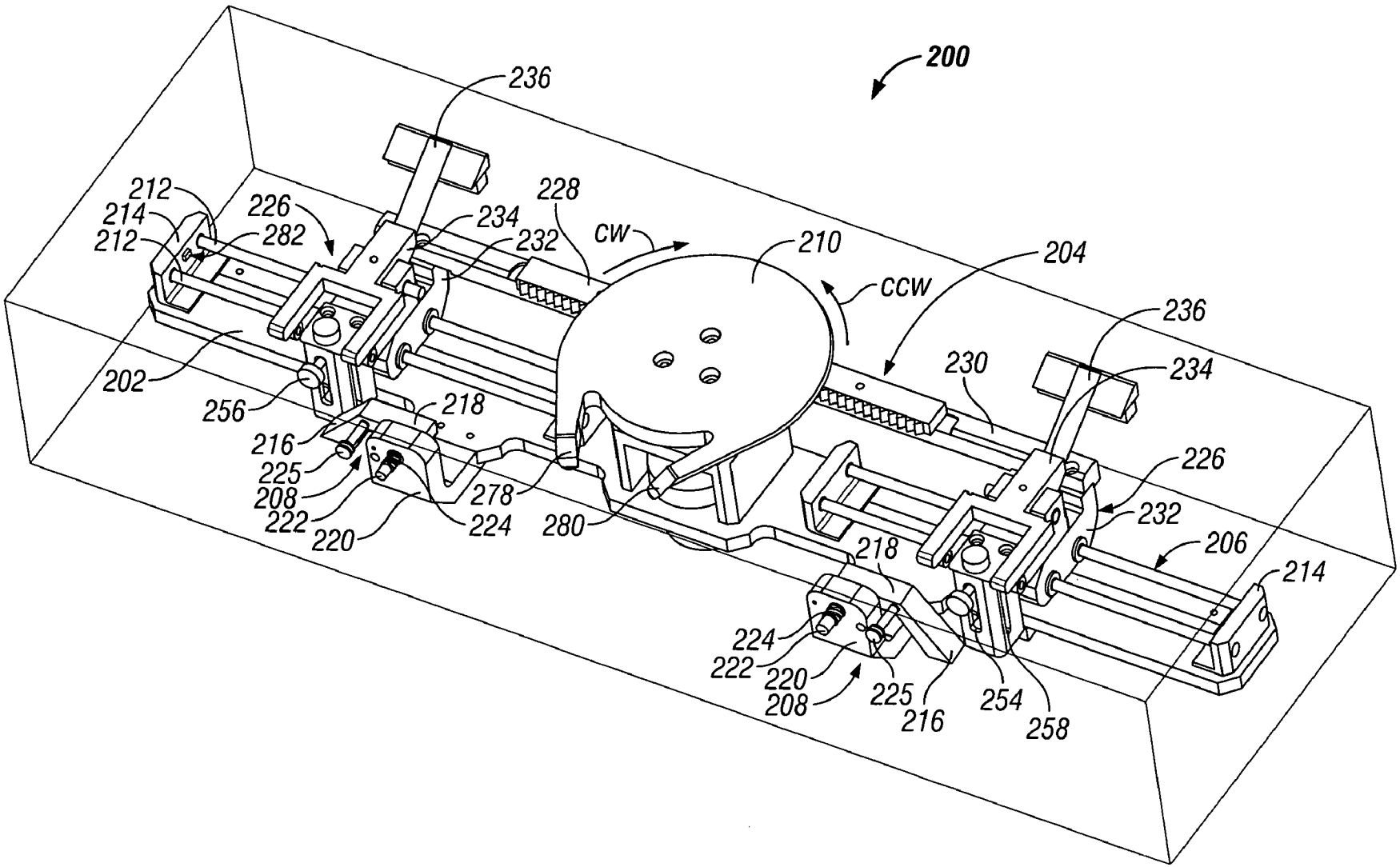
FIG. 11 is a front perspective view of a page turner according to a second embodiment of the present invention.
Figure 12:
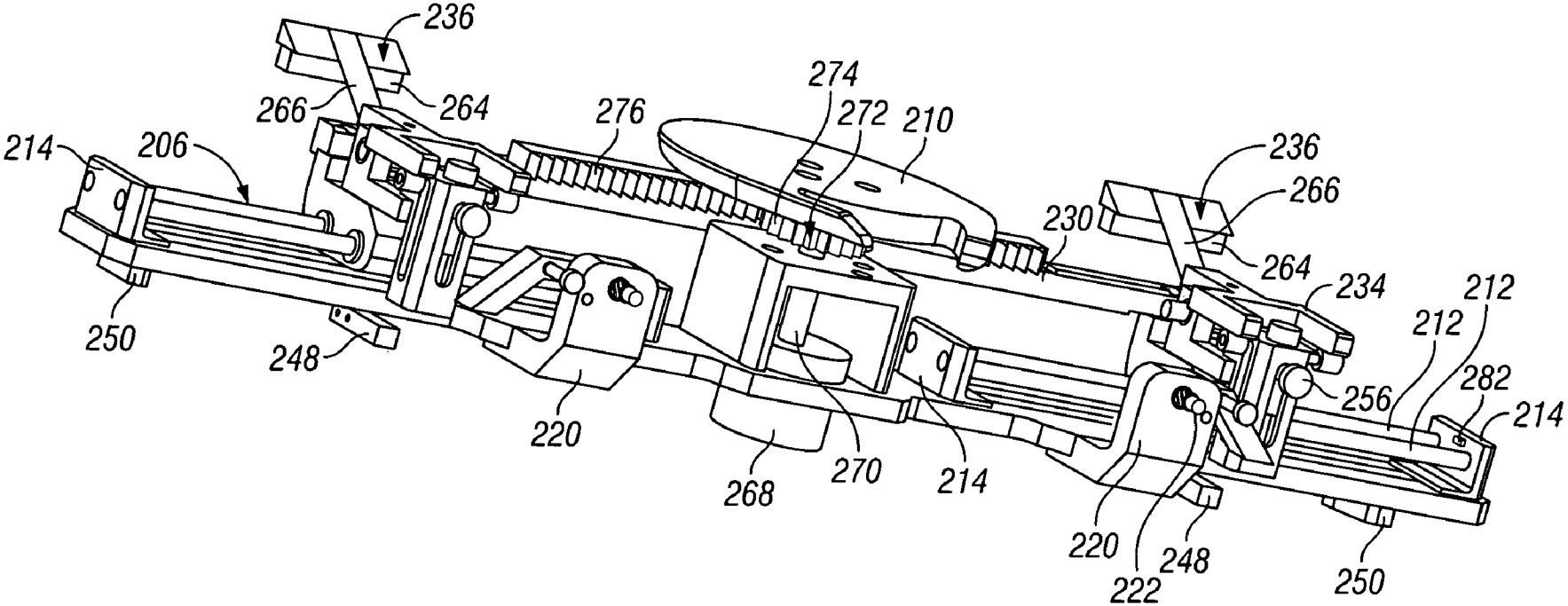
FIG. 12 is a front elevational view of the page turner of FIG. 11.
Figure 13:
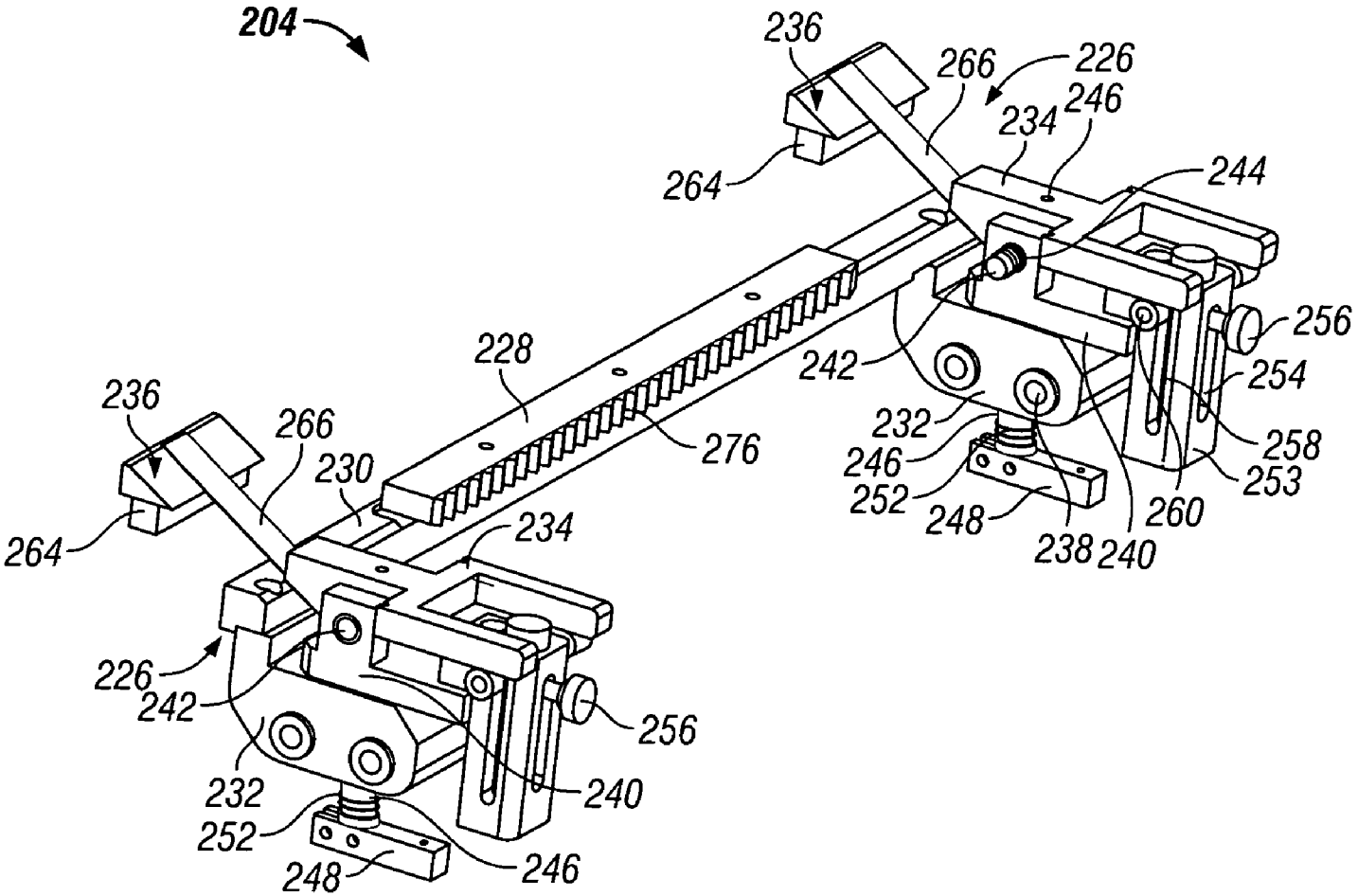
FIG. 13 is a side perspective view of the transport assembly of the page turner of FIG. 11.

A page turner 200 according to a second embodiment of the present invention is shown in FIGS. 11 to 13. The page turner 200 has a base 202, a transport assembly 204, two rail assemblies 206, two ramp assemblies 208, and a turnstile 210. Each rail assembly 206 has two parallel rods 212 that span the base 202. The two rods 212 are constrained by two end plates 214 that are connected to the base 202.

Each of the ramp assemblies 208 has an inclined ramp 216 and a top horizontal plate 218. A bracket 220 is connected to the base 202. A shaft 222 pivotally connects the ramp assembly 208 to the bracket 220 such that the ramp assembly 208 can rotate about the shaft 222. A torsion spring 224 on the shaft 222 applies a bias force to the ramp assembly 208. A stop pin 225 on the ramp assembly 208 contacts a side of the bracket 220 to keep the top plate 218 of the ramp assembly 208 in a horizontal position.

As shown in FIGS. 11 and 13, the transport assembly 204 has two yoke assemblies 226, one on each of the left and right sides, and a rack gear 228. A connecting bar 230 connects the two yoke assemblies 226 and supports the rack gear 228. The transport assembly 204 is moveable to the left and to the right over the rail assembly 206.

As shown in FIGS. 11, 12 and 13, each yoke assembly has a base 232, a yoke 234 coupled to the base 232, and a finger assembly 236 coupled to the yoke 234. The base 232 has two parallel cylindrical cavities 238 where the two rods 212 pass through so that the transport assembly 204 can move to the right and to the left.

The yoke 234 is pivotally connected to a base bracket 240 by a pin 242 and a torsional spring 244 that is coaxially located on the pin 242. A vertical pin 246 connects the base bracket 240 to the base 232 and passes through to a lever 248 located below the surface of the base 232. A limiting lever arm 250 is located near each end of the base 202 on an inferior face of the base 202, as shown in FIG. 12.

The base bracket 240 and the yoke 234 are rotatable around the vertical pin 246 when the transport assembly 204 is moved to either side where at such time the lever 248 contacts the lever arm 250. A torsional spring 252 applies a bias torque to the vertical pin 246 and keeps the lever arm 248 in a neutral position.

The base bracket 240 has a roller guide 253 having a slot 254 on its front face. A roller follower 256 is positioned inside of the slot 254 on the front face so as to be vertically moveable. The roller guide 253 also has two slots 258 on its side faces. A pin 260 is positioned in the slots 258 on the side faces so as to be vertically moveable. The pin 260 rests on the roller follower 256. The distal end of the yoke 234 is slideably coupled to the pin 260. Therefore, when the roller follower 256 is vertically displaced, so is the pin 260, the distal end of the yoke 234, and the associated finger assembly 236 rotates about the pin 242.

A torsional spring 244 applies a bias torque to the yoke 240 and pushes the pin 260, and the roller follower 256 to an inferior portion of the guide 253, namely at the heel of the ramp 216. This bias torque also brings the finger assembly 236 upward and above a book page. The finger assembly 236 has a tip 264 of flat rubber material and a leaf spring arm 266.

The turnstile 210 is coaxially connected to an electric motor 268 and a shaft 270 onto which a pinion gear 272 is mounted. The motor 268 is connected to the base 202. Teeth 274 on the pinion gear 272 are engaged with teeth 276 on the rack gear 228. The turnstile 210 is a large disc having two lifting fingers 278, 280.

The operation of the second embodiment will now be described where a page is turned from right to left. Once the motor 268 is energized, the pinion gear 272 and the turnstile 210 turn in a counterclockwise direction. The rotation of the pinion gear 272 and the turnstile 210 moves the rack gear 228 and the transport assembly 204 to the left. As the rack gear 228 and the transport assembly 204 move to the left, the roller follower 256 approaches the right ramp 216 and starts to climb up the ramp 216. The climbing of the roller follower 256 causes the yoke 234 to rotate relative to the base bracket 240 about the pin 242, thereby swinging the right finger assembly 236 down to the page. Once the roller 256 reaches the top of the ramp 216, the rubber at the tip 264 of the finger assembly 236 contacts the page and applies a soft pressure on the page while the finger assembly 236 is moving to the left. The pressure is adjustable by selecting different leaf spring arms 266.

As the transport assembly moves further to the left, the roller follower 256 goes over the top horizontal section plate 218 of the ramp assembly 208, and the finger assembly 236 starts to create a curl on the book page. At this moment, the lifting finger 278 of the rotating turnstile 210 goes under the curled page and transports the page to the other side. Once the roller follower 256 passes an end of the top horizontal plate 218 of the ramp assembly 208, the roller follower 256 drops down to the base 202 due to the torsional bias spring 244 coupled to the base bracket 240, which applies a continuous downward (compressive) force to the roller follower 256. The continuous compressive force from the torsional bias spring 244 also keeps the roller on the surface of the ramp.

As the page is being turned, the lever 248 of the left yoke assembly 226 contacts the left limiting arm 250, which causes the whole left yoke assembly 226 to turn counter-clockwise about the vertical pin 246 and move the left finger assembly 236 out of the way, allowing the book page to be turned without any obstruction. As the turnstile 210 continues to turn and move the transport assembly 204 to the left, the base 232 of the left yoke assembly contacts a left limiting switch 282 that is located on the left end plate 214. The left limiting switch 282 in turn, reverses the polarity of the electric current and thus changes the direction of the motor 268 to the clockwise direction. The changing of the motor direction, causes the transport assembly 204 to be moved to the right and return to the initial rest position. During this movement, the spring 252 on the left yoke assembly turns the left yoke to its original position. While the transport assembly 204 is being returned to its original position, the roller follower 256 of the right yoke moves under the ramp assembly 208.

In a reversible mode of operation, where a page is turned from left to right, the motor 268 is energized to be turned in the clockwise direction and the rack gear 228 is moved to the right. In this mode of operation, the roller follower 256 of the left yoke assembly 226 starts to move up the left ramp 216 and swings the left finger assembly 236 down to the page. The remaining page turning process proceeds as described above.

An automatic page turner according to the present invention can handle a wide variety of book sizes, page thicknesses, and books whose pages are not conditioned to readily lay flat when the book is opened. Additionally, all mechanical movement is coupled to a single motor, thereby enabling a low-cost design.

Although the present invention has been described in considerable detail with reference to certain preferred versions thereof, other versions are possible. Therefore, the spirit and scope of the appended claims should not be limited to the description of the preferred versions described herein.

All features disclosed in the specification, including the claims, abstracts and drawings, and all the steps in any method or process disclosed, may be combined in any combination except a combination where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means" for performing a specified function or "step" for performing a specified function, should not be interpreted as a "means" or "step" clause as specified in 35 U.S.C. §112.

What is claimed is:

1. An apparatus for turning bound pages, the apparatus comprising:
- a support assembly for holding the bound pages comprising:
  - a) an expandable bracket for supporting a spine of the bound pages;
  - b) a horizontal crossbar mounted on the expandable bracket; and
  - c) a pair of expandable folding arms coupled to the horizontal crossbar;
- a lifting assembly coupled to the support assembly and capable of lifting at least a portion of a page; and
- a turnstile assembly, the turnstile assembly comprising a plurality of flippers;
- a motor assembly coupled to the support assembly and coupled to the turnstile assembly;
- wherein the turnstile assembly has a rest position in which one of the plurality of flippers is positioned across two opposed bound pages to hold the bound pages in an open condition; and
- wherein the motor assembly rotates the turnstile assembly causing the lifting assembly to lift one of the pages and one of the plurality of flippers to rotate underneath the lifted page; and
- wherein the finger underneath the lifted page is rotated to turn the page and to place the turnstile in the rest position.

2. The apparatus for turning pages of claim 1 wherein the pages may be turned either forward or backward.

3. The apparatus for turning pages of claim 1 wherein the motor assembly further comprises:
- a reversible electric motor;
- a gear reducer coupled to the electric motor;
- an output shaft coupled to the gear reducer and to the turnstile assembly;
- a left limiting switch coupled to the electric motor; and
- a right limiting switch coupled to the electric motor.

4. The apparatus for turning pages of claim 3 wherein:
- the turnstile assembly further comprises:
- a disk coupled to the output shaft of the reducing gear, the disk having a top surface and a side surface;
- a plurality of pins coupled to the top surface of the disk; and
- a plurality of limiting pins coupled to the side surface of the disk, each of the limiting pins being engageable with the left limiting switch and the right limiting switch.

5. The apparatus for turning pages of claim 4 wherein the lifting assembly further comprises a right lifting assembly and a left lifting assembly;
- wherein a wheel is coupled to the support assembly;
- wherein each of the right lifting assembly and the left lifting assembly further comprises:
- a base assembly comprising:
  - a track;
  - a board slideably coupled to the track;
  - an L-shaped bracket coupled to the board, the L-shaped bracket having a rotatable bias pin, wherein the bias pin is engageable with at least one of the plurality of pins coupled to the top surface of the disk; and a linkage rotatably coupled to the board; and a finger assembly comprising:

a bar;

a yoke pivotally coupled to the board and rotatably coupled to the bar;

a cam coupled to the bar, the cam being engageable with the roller coupled to the support assembly;

wherein upon rotation of the turnstile assembly, at least one of the plurality of pins on the disc engages the pin on the L-shaped bracket causing the board to slide along the track and the cam to engage with the roller coupled to the support assembly, thereby causing the bar to rotate relative to the yoke, thereby bringing an end of the bar into contact with a page; and wherein continued rotation of the turnstile assembly causes the linkage to engage another of the plurality of pins on the disc, thereby causing the linkage to rotate the bar and the yoke relative to the board, thereby lifting a page.

6. The apparatus for turning pages of claim 5 wherein the finger assembly further comprises a flexible bellow attached to the distal end of the bar.

7. The apparatus for turning pages of claim 5 wherein each of the right lifting assembly and the left lifting assembly further comprises:

a first spring coupled to the linkage and the board, the first spring exerting a bias force against the linkage; and a second spring coupled to board and the track, the second spring exerting a bias force against the board.

8. The apparatus for turning pages of claim 1 further comprising at least one button electrically coupled to the motor for energizing the motor.

9. The apparatus for turning pages of claim 1 further comprising at least one of a foot pedal, a breath-controlled switch, a chin switch, a voice activation device, and a computerized timer electrically coupled to the motor for energizing the motor.

10. A method for turning bound pages comprising:

selecting the apparatus of claim 1;

placing bound pages in the support assembly; and energizing the motor assembly to turn at least one of the bound pages.

11. An apparatus for turning bound pages, the apparatus comprising:

a rotatable turnstile assembly, the turnstile assembly comprising:

a pinion gear; and two lifting fingers;

a transportation assembly coupled to the turnstile assembly, the transportation assembly comprising:

a plurality of finger assemblies;

a rack gear coupled to the pinion gear; and two yoke assemblies coupled to the rack gear, each yoke assembly further comprising:

a base slideably coupled to the plurality of rods;

a base bracket rotatably coupled to the base; and a yoke coupled to one of the finger assemblies, the yoke being rotatably coupled to the base bracket;

a plurality of rods extending in the lateral direction from the rotatable turnstile assembly;

wherein the transportation assembly has a rest position in which the finger assemblies hold the bound pages in an open condition;

wherein rotation of the pinion gear moves the rack gear, causing the yoke assemblies and the finger assemblies to move along the plurality of rods;

wherein rotation of the turnstile assembly moves the transportation assembly in a lateral direction to lift one of the pages and moves the lifting finger underneath the lifted page; and wherein the lifting finger underneath the lifted page is rotated to turn the page.

12. The apparatus for turning pages of claim 11 further comprising two ramp assemblies;

wherein each of the yokes further comprises a roller follower; and wherein the roller follower of one yoke engages one of the ramp assemblies as the transportation assembly is moved in the lateral direction to rotate the yoke and bring the finger assembly coupled to the yoke into contact with the book page.

13. The apparatus for turning pages of claim 12 further comprising two limiting lever arms;

wherein each of the base brackets further comprises a lever arm; and wherein the lever arm of one base bracket engages one of the limiting lever arms as the transportation assembly is moved in the lateral direction to rotate the base bracket, the yoke, and the finger assembly coupled to the yoke away from the book page.

14. The apparatus for turning pages of claim 11 further comprising:

a reversible electric motor coupled to the turnstile assembly;

a limiting switch which upon contact with the transportation assembly reverses the direction of the motor to move the transportation assembly back to the rest position.

15. The apparatus for automatically turning pages of claim 14 further comprising at least one button electrically coupled to the motor for energizing the motor.

16. The apparatus for automatically turning pages of claim 14 further comprising at least one of a foot pedal, a breath-controlled switch, a chin switch, a voice activation device, and a computerized timer electrically coupled to the motor for energizing the motor.

17. The apparatus for turning pages of claim 11 wherein the pages may be turned either forward or backward.

18. The apparatus of claim 11, wherein each finger assembly further comprises a rubber tip.

19. An apparatus for turning bound pages, the apparatus comprising:

a support assembly for holding the bound pages;

a lifting assembly coupled to the support assembly and capable of lifting at least a portion of a page; and a turnstile assembly, the turnstile assembly comprising a plurality of flippers;

a motor assembly coupled to the support assembly and coupled to the turnstile assembly;

wherein the motor assembly further comprises:

a reversible electric motor;

a gear reducer coupled to the electric motor;

an output shaft coupled to the gear reducer and to the turnstile assembly;

a left limiting switch coupled to the electric motor; and a right limiting switch coupled to the electric motor;

wherein the turnstile assembly has a rest position in which one of the plurality of flippers is positioned across two opposed bound pages to hold the bound pages in an open condition; and wherein the motor assembly rotates the turnstile assembly causing the lifting assembly to lift one of the pages and one of the plurality of flippers to rotate underneath the lifted page; and wherein the finger underneath the lifted page is rotated to turn the page and to place the turnstile in the rest position.

20. The apparatus for turning pages of claim 19 wherein: the turnstile assembly further comprises:

a disk coupled to the output shaft of the reducing gear, the disk having a top surface and a side surface;

a plurality of pins coupled to the top surface of the disk; and a plurality of limiting pins coupled to the side surface of the disk, each of the limiting pins being engageable with the left limiting switch and the right limiting switch.

21. The apparatus for turning pages of claim 20 wherein the lifting assembly further comprises a right lifting assembly and a left lifting assembly;

wherein a wheel is coupled to the support assembly;

wherein each of the right lifting assembly and the left lifting assembly further comprises:

a base assembly comprising:

a track;

a board slideably coupled to the track;

an L-shaped bracket coupled to the board, the L-shaped bracket having a rotatable bias pin, wherein the bias pin is engageable with at least one of the plurality of pins coupled to the top surface of the disk; and a linkage rotatably coupled to the board; and a finger assembly comprising:

a bar;

a yoke pivotally coupled to the board and rotatably coupled to the bar;

a cam coupled to the bar, the cam being engageable with the roller coupled to the support assembly;

wherein upon rotation of the turnstile assembly, at least one of the plurality of pins on the disc engages the pin on the L-shaped bracket causing the board to slide along the track and the cam to engage with the roller coupled to the support assembly, thereby causing the bar to rotate relative to the yoke, thereby bringing an end of the bar into contact with a page; and wherein continued rotation of the turnstile assembly causes the linkage to engage another of the plurality of pins on the disc, thereby causing the linkage to rotate the bar and the yoke relative to the board, thereby lifting a page.

22. The apparatus for turning pages of claim 21 wherein the finger assembly further comprises a flexible bellow attached to the distal end of the bar.

23. The apparatus for turning pages of claim 21 wherein each of the right lifting assembly and the left lifting assembly further comprises:

a first spring coupled to the linkage and the board, the first spring exerting a bias force against the linkage; and a second spring coupled to board and the track, the second spring exerting a bias force against the board.

24. The apparatus for turning pages of claim 19 further comprising at least one button electrically coupled to the motor for energizing the motor.

25. The apparatus for turning pages of claim 19 further comprising at least one of a foot pedal, a breath-controlled switch, a chin switch, a voice activation device, and a computerized timer electrically coupled to the motor for energizing the motor.

26. A method for turning bound pages comprising:

selecting the apparatus of claim 19;

placing bound pages in the support assembly; and energizing the motor assembly to turn at least one of the bound pages.

* * * * *